United States Patent [19]

Daniels

[11] 4,359,851

[45] Nov. 23, 1982

[54] DECK APPARATUS

[76] Inventor: Phillip D. Daniels, 4797 Lake Bluff, West Bloomfield, Mich. 38033

[21] Appl. No.: 114,635

[22] Filed: Jan. 23, 1980

[51] Int. Cl.[3] ..... F16B 7/00

[52] U.S. Cl. ..... 52/298; 256/59; 256/65; 403/230

[58] Field of Search ..... 256/59, 65, DIG. 6, 256/24; 52/298, 261; 403/230

[56] References Cited

U.S. PATENT DOCUMENTS

| | | | |
|---|---|---|---|
| 1,797,883 | 3/1931 | Strubel | 256/65 |
| 3,615,110 | 10/1971 | Fugate | 256/65 |
| 4,181,292 | 1/1980 | Hubel | 256/65 |

*Primary Examiner*—John E. Murtagh
*Attorney, Agent, or Firm*—Hiram P. Settle

[57] ABSTRACT

A bracket for interconnecting a vertical post and a support element, typically a vertical post for supporting a guard rail surrounding a wooden, above-ground deck. The post can be either wooden or metal, and the identical bracket which connects the post to the deck can be simply inverted and utilized to inter-connect the post and the upper guard rail. The bracket supports the upstanding post at each end from adjacent vertical and horizontal surfaces of the deck structure and/or the handrail structure by means of integrally formed flanges and flange extensions which are in flat-wise contact with the respective surfaces on either side of a central recess which receives the post. The flanges and flange extensions, which are at right angles to one another, stabilize the post both vertically and laterally, particularly since they provide laterally spaced fastener locations beyond the confines of the post itself. These vertical and horizontal locations facilitate the securing of the post to the primary structural elements of both the deck and the guard rail to provide maximum security and strength for the guard rail with a single, multi-use bracket which does not interfere with the aesthetic appearance of the deck.

1 Claim, 5 Drawing Figures

DECK APPARATUS

BACKGROUND OF THE INVENTION

One of the major do-it-yourself improvement which homeowners make in their homes is the construction of exterior decks, which serve as outside entertainment centers, swimming pool extensions, child play areas and the like. Such decks are generally elevated above the ground level and, for both safety and compliance with local building codes, these elevated structures require guard rails located from two to three feet above the deck surface. While it is possible to construct such deck guard rails by wood-to-wood construction utilizing vertical posts bolted or otherwise secured to both the deck and the upper rail, it is a complicated, time consuming, difficult task to construct such a rail which is neither unsightly nor unsafe.

The prior art has proposed metal brackets for interconnecting a guard rail post to the deck. One such prior art structure is illustrated in U.S. Pat. No. 4,081,940, wherein a metal post of rectangular tubular construction simply has supporting plates welded to its remote ends for abutting contact with a deck support element at one extremity and to the guard rail structure at the other extremity. Such metal post assemblies are expensive, detract from the wooden appearance of the deck, come in limited lengths only, and rely for safety solely upon the integrity of the welded connections. An alternative bracket structure in the prior art consists simply of a "U"-shaped sheet metal bracket which is attached to the post adjacent its lower extremity and which has a metal tang or tongue which projects inwardly to be secured to the upper surface of the deck by screws or nails. This type of bracket imparts no lateral stability to the post, since the tang or tongue is completely within the confines of the post itself, there is no connection of the post to the deck structure other than through the tang or tongue, a direct connection to a structural member of the deck can be accomplished only by drilling completely through the post and the structural component and installing elongated bolts, and this type of bracket cannot be used to connect the post with the rail structure.

There does exist in the art of wooden deck construction a need for a simple, inexpensive bracket useful for inter-connecting a support post to either the deck structure or the guard rail structure and which is both structurally sound and adaptable to both metal and wooden posts.

BRIEF DESCRIPTION OF THE PRESENT INVENTION

The present invention provides such a bracket which is a simple, stamped, unitary element, which is versatile in its utilization in connection with either metal or wooden posts, which is structurally sound upon installation without requiring any extensive drilling or fastening operations, and which serves to connect a post to both the deck and the guard rail by simple inversion of the bracket.

More specifically, the bracket of the present invention includes a central post-receiving recess defined by an end wall and two side walls of an overall "U"-shaped configuration, a mounting flange integral with each side wall and lying at right angles thereto for abutting a vertical structural support surface of either the deck or the guard rail, and a flange extension integral with each of the flanges and lying at right angles thereto for face-to-face contact with a horizontal surface of the same deck or rail structural element. The bracket end wall, the bracket flanges, and the bracket flange extensions are all provided with apertures for receiving fasteners, preferrably screws, for connecting the bracket to both the post and the adjacent structural member.

This extremely simple inter-connecting bracket affords extended surface contact with the post and with the structural member to which the post is to be attached. This extended surface contact is both lateral and vertical to support the post against any load to which it may be subjected, for example, against the load imposed by a person standing on the deck and leaning back against the guard rail. Such a load is resisted by the bracket by virtue of the extended post-bracket contact and a plurality of fasteners maintaining such contact, and by those portions of the bracket in both vertical and horizontal contact with the adjacent structural member and the fastener means imbedded in the structural member. The bracket also resists any lateral forces imposed upon the post or the deck structural member or the guard rail structural member by virtue of the flanges and flange extensions which are located on either side of the post to stabilize and spread any such lateral loads.

BRIEF DESCRIPTION OF THE DRAWINGS

ON THE DRAWINGS

Figure 1:
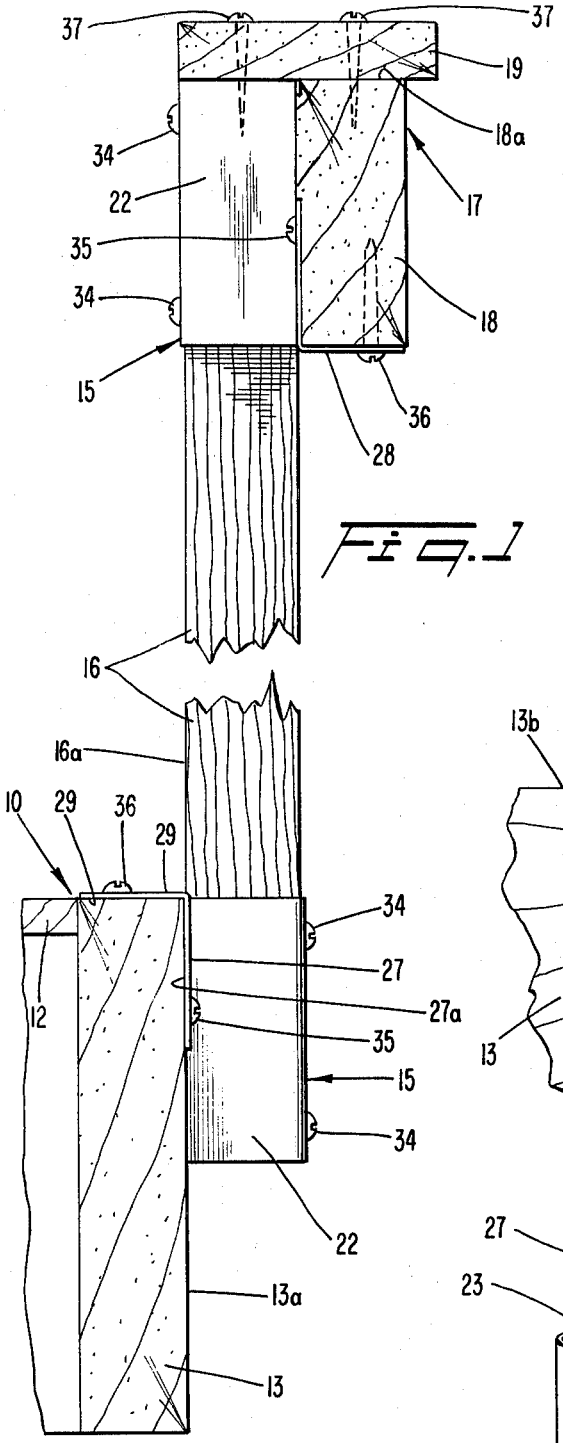
Figure 4:
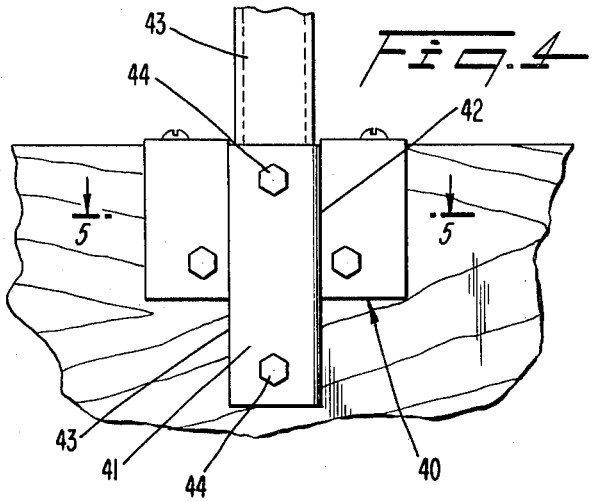
Figure 2:
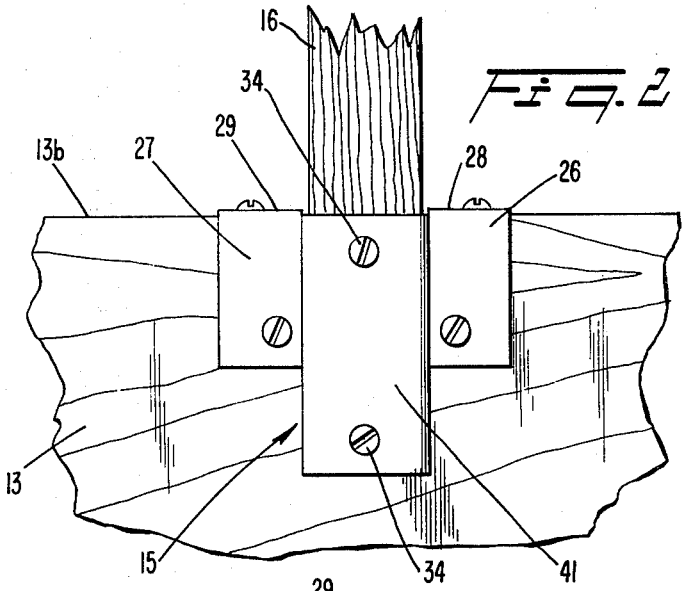
Figure 5:
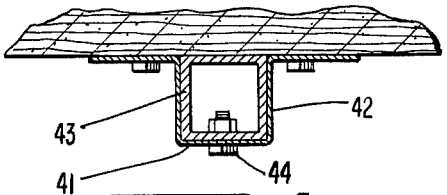
Figure 3:
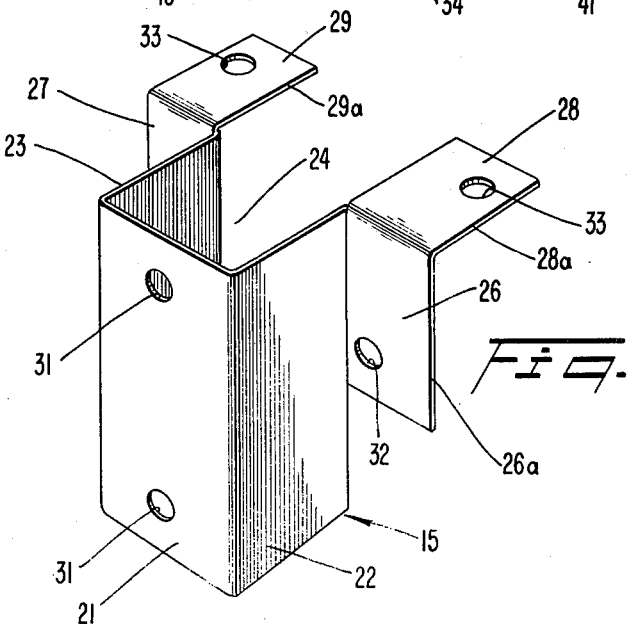

FIG. 1 is a vertical sectional view, with parts shown in elevation, of a deck structure incorporating therein brackets of the present invention;

FIG. 2 is a fragmentary elevational view of the deck structure of FIG. 1 further illustrating a single bracket of the present invention, as installed;

FIG. 3 is an enlarged perspective view of a bracket of the present invention;

FIG. 4 is a view similar to FIG. 2 illustrating a bracket of the present invention utilized with a metal post; and FIG. 5 is a sectional view taken along the plane 5—5 of FIG. 4.

DETAILED DESCRIPTION OF THE PRESENT INVENTION

Referring to FIG. 1 of the drawings, reference numeral 10 refers generally to a deck comprising a beam or joist 11 carrying deck surface or floor boards 12 and joined to a fascia member 13 which defines the perimeter of the deck and which is a primary structural element of the deck, this wooden fascia element 13 being inter-connected to the beams of joists 11 as described in detail in my pending patent application Ser. No. 73,073 filed in the United States Patent Office on Sept. 6, 1979.

Secured to the fascia element 13 is a bracket 15 of the present invention which serves to support an upstanding, vertical wooden post 16 surmounted by a second identical bracket 15 of the present invention which is inverted relative to the first described bracket 15 and which serves to inter-connect the post 16 with a guard rail structure indicated generally at 17 and comprising a guard rail support element 18 which circumscribes the guard rail support structure and which is surmounted by a handrail 19.

The bracket 15 is illustrated in detail in FIG. 3 of the drawings, from which it will be seen that the bracket is stamped from a single piece of sheet metal. The bracket 15 comprises an end wall 21 integrally joined to a pair of side walls 22, 23 to define a "U"-shaped recess 24 which is of a size to snuggly receive therein an end portion of a post 16.

Integrally formed with each of the side walls 22, 23 is a laterally deflected flange 26, 27 which extends vertically in the normal orientation of the bracket during utilization. Each of these flanges 26, 27 is planar and is adapted to abut a vertical surface of one of the structural members 13, 18 heretofore described. Integral with each of the flanges 26, 27 is a flange extension 28, 29 which also is planar and which extends at right angles to the flange 26 to lie horizontally in the normal orientation of the bracket in its final assembled utilization. The end wall 21 is provided with a pair of apertures 31 for receiving a fastener serving to retain an end portion of the post 16 therein. Each of the flanges 26, 27 is provided with an aperture 32 to receive a fastener for securing the flange to an adjacent vertical surface of a structural element 13, 18, and each of the flange extensions 28, 29 is apertured, as at 33 to receive a fastener serving to secure the flange extension to a horizontal surface of a support element 13, 18, all as hereinafter more fully described.

It will be noted that the flanges 26, 27 are of lesser vertical extent than the side walls 22, 23 by an amount equal to the length of the flanges extensions 28, 29. As a result, the brackets 15 can be formed in a progressive die from continuous metal strip without any wastage of material, since the material required for the flange extensions 28, 29 is obtained from a next successive blank, since the side walls 22, 23 project below the lower extremities of the fore-shortened flanges 26, 27.

The utilization of the brackets 15 is best shown in FIGS. 1 and 2, from which it will be seen that each post 16 has its lower end received by the recess 24 defined by the side walls 22 and the end wall 21. The post is secured in the recess 24 by means of fasteners, such as screws 34, extending through the apertures 31 and having their threaded ends imbedded in the post 16. The lower extremity of the inner surface 16-A of the post contacts the exterior surface 13-A of the support element or fascia 13 in extended surface contact. As shown, the post 16 is coextensive, at its lower extremity, with the lower end of the recess 24, although there is no reason that the post could not project downwardly through the open lower end of the recess 24, if such is desired. Preferrably, the post 16 is initially secured within the bracket recess 24 by the screws 34 as the first assembly step.

Next, the sub-assembly of the post 16 and the bracket 15 are positioned as illustrated in FIGS. 1 and 2 upon the fascia 13 with the interior flange surfaces **26*a* and 27*a* contacting the surface 13*a* of the fascia and screws 35 are utilized to assemble the bracket and post sub-assembly onto the fascia. During this assembly operation, the extension undersurfaces 28*a* and 29*a* contact the exposed upper surface 13*b* of the fascia 13 to locate the post-bracket sub-assembly on the fascia. When the screws 36 are utilized to secure the flange extensions 28, 29 to the upper surface of the fascia 13, the sub-assembly of the post 16 and the bracket 15** is fully assembled to the deck structure.

At the upper end of each post, the bracket 15 is relatively inverted so that the flange extensions 28, 29 are downward, at the lower end of the bracket. Normally, the upper bracket 15 is secured to the post 16 at the same time as the lower bracket 15 is assembled to the post using the same procedures and the fastening means 34 as above described. The guard rail support element 18 is then assembled to the flange extensions and the flanges 26, 27 as heretofore described utilizing the screws 36, 35 respectively. Preferrably, the vertical extent of the bracket 15 is the same as that of a standard 2 inch by 4 inch board so that the upper extremity **18*a* of the structural element 18 is flush with the upper extremity of the bracket 15 to provide a continuous lateral support for the facing board 19, and this facing board can then be installed, as by screws 37**.

As above explained, the bracket of the present invention can also be utilized with metal support posts, and this version of the invention is illustrated in FIGS. 4 and 5 of the drawings. It will be seen that the bracket indicated generally at 40 is substantially the same in shape and configuration to the bracket 15 earlier described, with the exception that the end wall 41 and the side walls 42 of the bracket are of reduced dimensions to receive the metal post 43 which is of smaller size than the wooden post 16 heretofore described. Generally, for safety, the wooden post 16 is 2 inches by 2 inches in cross-sectional dimension, while a metal post 43 is about 1 inch by 1 inch in cross-section. The method of installing the metal post 43 is identical with that earlier described, except that the post 43 is apertured in registry with the bracket apertures 31 to receive securing bolts 44.

From the foregoing description, the structure and function of the bracket of the present invention will be readily comprehended, and the utility of the bracket to inter-connect each end of a vertical support post to the remainder of the deck structure will be evident. The lateral stability of the resultant rail structure, as well as its enhanced resistance to outwardly thrusting loads, will be appreciated.

I claim:

1. In a permanent wooden deck structure having a deck perimeter-defining fascia element, a guard rail element overlying the fascia element, and vertical support post for joining said support element and said rail element, the improvements of identical upper and lower brackets, the upper bracket interconnecting said rail element and one of said posts, and the lower bracket interconnecting said fascia element and said one of said posts, each such bracket having a medial portion defining a vertical passage open at its vertical extremities and snugly receiving an end portion of the post therein, a laterally projecting vertical flange on each side of said medial portion contacting a vertical surface of the associated one of said elements, said vertical flange terminating at one edge of said passage and a horizontal pre-formed flange extension on each such flange at said one edge of said passage contacting an adjacent horizontal surface of said element, the brackets being relatively vertically reversible so that the passage edge and the flange extension of the lower bracket contact the upper surface of said fascia element and the passage edge and the flange extension of the upper bracket contact the undersurface of said rail element, and the bracket medial portions, flanges and flange extensions each being apertured for the reception of fastening means.

* * * * *